United States Patent [19]

Chang

[11] Patent Number: 4,888,064

[45] Date of Patent: Dec. 19, 1989

[54] METHOD OF FORMING STRONG FATIGUE CRACK RESISTANT NICKEL BASE SUPERALLOY AND PRODUCT FORMED

[75] Inventor: Keh-Minn Chang, Schenectady, N.Y.

[73] Assignee: General Electric Company, Schenectady, N.Y.

[21] Appl. No.: 907,276

[22] Filed: Sep. 15, 1986

[51] Int. Cl.[4] ..... C22F 1/10

[52] U.S. Cl. ..... 148/2; 148/3; 148/11.5 N; 148/11.5 P; 148/12.7 N; 148/162; 148/410; 148/428

[58] Field of Search ..... 148/11.5 N, 11.5 P, 148/12.7 N, 162, 2, 3, 410, 428; 420/448

[56] References Cited

U.S. PATENT DOCUMENTS 4,685,977 8/1987 Chang ..... 148/12.7 N

*Primary Examiner*—R. Dean

*Attorney, Agent, or Firm*—Paul E. Rochford; James C. Davis, Jr.; James Magee, Jr.

[57] ABSTRACT

A novel alloy is provided having approximately the following ingredient formula:

| Element | Composition in weight % |
|---|---|
| Ni | balance |
| Cr | 16 |
| Co | 18 |
| Mo | 5.00 |
| W | 5.00 |
| Al | 2.50 |
| Ti | 3.00 |
| Nb | 3.00 |
| Zr | 0.05 |
| B | 0.01 |
| C | 0.075 |

The alloy has a low solvus temperature for the $\gamma'$ precipitate thus facilitating metal processing and treatment and also forging of the metal. Fatigue crack propagation rate is remarkably low for metal samples cooled at rates of 20° C./min to 200° C./min.

13 Claims, 9 Drawing Sheets

METHOD OF FORMING STRONG FATIGUE CRACK RESISTANT NICKEL BASE SUPERALLOY AND PRODUCT FORMED

RELATED APPLICATIONS

The subject matter of this application relates generally to that of these concurrently assigned, concurrently filed applications, the texts of which are hereby incorporated herein by reference as follows: Ser. No. 907,271 (Attorney Docket RD-16103), Ser. No. 907550 (RD-17159; and Ser. No. 907,275 (RD-17469).

The subject application also relates generally to the subject matter of application Ser. No. 677,449, filed Dec. 3, 1984, U.S. Pat. No. 4,685,977 which application is assigned to the same assignee as the subject application herein. The text of the related application is incorporated here by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of a 1000F or more.

Many of the nickel-based superalloys depend for part of their strength and other properties at high temperature on $\gamma'$ precipitates. Some detailed characteristics of the phase chemistry of $\gamma'$ are given in "Phase Chemistries in Precipitation-Strengthening Superalloy" by E. L. Hall, Y. M. Kouh and K. M. Chang, "Proceedings of 41st Annual Meeting of Electron Microscopy Society of America, August 1983 [(p. 248)].

The following U.S. patents disclose various nickel-base alloy compositions: U.S. Pat. Nos. 2,570,193; 2,621,122; 3,046,108; 3,061,426; 3,151,981; 3,166,412; 3,322,534; 3,343,950; 3,575,734; 3,576,681, 4,207,098 and 4,336,312. The aforementioned patents are representative of the many alloying situations reported to date in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

The objectives for forgeable nickel-base superalloys of this invention are to develop new alloy compositions which have minimum time dependence of fatigue cracking resistance, and which have high values for strength at room temperature and at elevated temperatures and extended stress rupture life.

Other objectives for forgeable nickel-base superalloys of this invention is the provision of an alloy system which is not sensitive to different cooling treatments but which may be subjected to a range of cooling treatments without significant deterioration or loss of desirable alloy properties.

A problem which has been recognized to a greater and greater degree with many such nickel based superalloys is that they are subject to formation of cracks or incipient cracks, either in fabrication or in use, and that the cracks can actually initiate or propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous and can be catastrophic.

However, what has been poorly understood until recent studies were conducted was that the formation and the propagation of cracks in structures formed of superalloys is not a monolithic phenomena in which all cracks are formed and propagated by the same mechanism and at the same rate and according to the same criteria. By contrast the complexity of the crack generation and propagation and of the crack phenomena generally and the interdependence of such propagation with the manner in which stress is applied is a subject on which important new information has been gathered in recent years. The period during which stress is applied to a member to develop or propagate a crack, the intensity of the stress applied, the rate of application and of removal of stress to an from the member and the schedule of this application was not well understood in the industry until a study was conducted under contract to the National Aeronautics and Space Administration. This study is reported to a technical report identified as NASA CR-165123 issued from the National Aeronautics and Space Administration in August 1980, identified as "Evaluation of the Cyclic Behavior of Aircraft Turbine Disk Alloys" Part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the finding from the NASA sponsored study that the application of stress of lower frequencies rather than at the higher frequencies previously employed in studies, actually increased the rate of crack propagation. In other words the NASA study revealed that there was a time dependence in fatigue crack propagation. Further the time dependence of fatigue crack propagation was found to depend not on frequency alone but on the time during which the member was held under stress for a so-called hold-time.

Following the discovery of this unusual and unexpected phenomena of increased fatigue crack propagation at lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

However, it has been discovered that it is feasible to construct parts of nickel based superalloys for use at high stress in turbines and aircraft engines with greatly reduced crack propagation rates.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma$ a. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys.

The most undesirable time-dependent crack-growth behavior has been found to occur when a hold time is superimposed on a sine wave variation in stress. In such case a test sample may be subjected to stress in a sine wave pattern but when the sample is at maximum stress the stress is held constant for a hold time. When the hold time completed the sine wave application of stress is resumed. According to this hold time pattern the stress is held for a designated hold time each time the stress reaches a maximum in following the normal sine curve. This hold time pattern of application of stress is a separate criteria for studying crack growth. This type of hold time pattern was used in the NASA study referred to above.

Low cycle fatigue life is considered to be a limiting factor for the components of turbine engines and jet engines which are subject to rotary motion or similar periodic or cyclic high stress.

Progress has been made in forming superalloy metal compositions containing high volume percents of strengthening precipitates and in processing of these metals into parts for advanced turbine engines and jet aircraft engines. This metal processing technology has been developed to introduce such superalloys into gas turbines and jet engines because of the higher temperature capabilities of the alloys themselves and because the engines built with such alloys also have higher temperature capabilities and resulting higher efficiencies and thrust per unit weight of engine. While some studies such as the NASA studies described above have been made of a number of these alloys, not all of the alloys have been examined comprehensively with respect to fatigue cracking and with respect to resistance to fatigue cracking.

It has been determined that at low temperatures the fatigue crack propagation depends essentially entirely on the intensity at which stress is applied to components and parts of such structures in a cyclic fashion. As is partially explained in the background statement above, the crack growth rate at elevated temperatures cannot be determined simply as a function of the applied cyclic stress intensity $\Delta K$. Rather the fatigue frequency can also affect the propagation rate. The NASA study demonstrated that the slower the cyclic frequency, the faster the crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters.

It is known that some of the most demanding sets of properties for superalloys are those which are needed in connection with jet engine construction. Of the sets of properties which are needed, those which are needed for the moving parts of the engine are usually greater than those needed for static parts although the sets of needed properties are different for the different components of an engine.

Because some sets of properties have not been attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide, the place where that speck occurs in the moving part becomes a latent weak spot where a crack may initiate or a latent crack.

As alloy products for use in turbines and jet engines have developed, it has become apparent that different sets of properties are needed for parts which are employed in different parts of the engine or turbine. For jet engines, the material requirements of more advanced aircraft engines continue to become more strict as the performance requirements of the aircraft engines are increased. The different requirements are evidenced, for example, by the fact that many blade alloys display very good high temperature properties in the cast form. However, the direct conversion of cast blade alloys into disk alloys is very unlikely because blade alloys display inadequate strength at intermediate temperatures of about 700° C. Further, the blade alloys have been found very difficult to forge and forging has been found desirable in the fabrication of blade from disk alloys. Moreover, the crack growth resistance of disk alloys has not been evaluated.

Accordingly, to achieve increased engine efficiency and greater performance, constant demands are made for improvements in the strength and temperature capability of disk alloys as a special group of alloys for use in aircraft engines. Now, these capabilities must be coupled with low fatigue crack propagation rates and a low order of time-dependency of such rates.

What was sought in undertaking the work which leads to the present invention was the development of a disk alloy which resulted in a lower or minimum time dependence of fatigue crack propagation and moreover a high resistance to fatigue cracking. Further, what was sought, was high strength and long stress rupture life.

A main objective was to provide a composition which has a high resistance to time dependent fatigue crack propagation. One way in which this objective is achieved is through extending the cooling rate for preparation of the composition. One thing that is unique in the composition of this invention is that it permits a broad range of variation in the cooling rate but still provides the desired resistance to time dependent fatigue crack propagation. In other words this is a unique alloy because it not only has time dependent fatigue crack propagation resistant properties but these properties are achieved and can be achieved over a broad range of cooling rates.

In addition the accomplishment of the time dependent fatigue crack propagation resistance at this broad range of cooling rate does not detract from other properties of the alloy as the alloy itself does have a good combination of strength and rupture life. Also this exceptional combination of properties is achieved at cooling rates over any part of a broad range where such cooling is responsible for the resulting properties of the time dependent fatigue crack propagation resistant alloy. In other words there is no loss of strength or rupture life properties over this whole cooling rate range. The alloy which is prepared according to the present invention not only has the good resistance to fatigue crack propagation but it has good strength and good rupture life.

BRIEF DESCRIPTION OF THE INVENTION

It is, accordingly, one object of the present invention to provide nickel-base superalloy products which are more resistant to cracking.

Another object is to provide a method and composition for reducing the tendency of nickel-base superalloys to undergo cracking.

Another object is to provide articles for use under cyclic high stress which are more resistant to fatigue crack propagation.

Another object is to provide a composition and method which permits nickel-base superalloys to have imparted thereto resistance to cracking under stress which is applied cyclically over a range of frequencies.

Other objects will be in part apparent and in part pointed out in the description which follows.

In one of its broader aspects, objects of the invention can be achieved by providing a composition of the following approximate content:

| | Composition in weight % | |
|---|---|---|
| Element | Nominal | Range |
| Ni | bal. | bal. |
| Cr | 16 | 13—18 |
| Co | 18 | 15—20 |
| Mo | 5 | 3—6 |
| W | 5 | 3—6 |
| Al | 2.5 | 2—4 |
| Ti | 3.0 | 2—4 |
| Nb | 3.0 | 2—4 |
| Zr | 0.05 | 0.02—0.08 |
| B | 0.01 | 0.005—0.03 |
| C | 0.075 | less than 0.1 |

The nominal composition is the composition containing percentages of ingredients by weight which were specified and sought in preparing compositions as set out in the Examples below.

The range of compositions set forth the percentage of ingredients which are deemed to provide the novel sets of properties as also more fully set forth below.

In respect to nickel the term "balance essentially" is used to include, in addition to nickel in the balance of the alloy, small amounts of impurities and incidental elements, which in character and/or amount do not adversely affect the advantageous aspects of the alloy.

In preparing the alloy, the steps which may be employed include melting the composition to form a melt, cooling the melt to form an alloy with a $\gamma'$ precipitate content of about 45% by volume, solution annealing the alloy at 1125° C. for 1 hour to provide a supersolvus anneal; aging the alloy at about 760° C. for about 16 hours, and cooling the alloy.

BRIEF DESCRIPTION OF THE DRAWINGS

In the description which follows clarity of understanding will be gained by reference to the accompanying drawings in which.

DETAILED DESCRIPTION OF THE INVENTION

Figure 1:
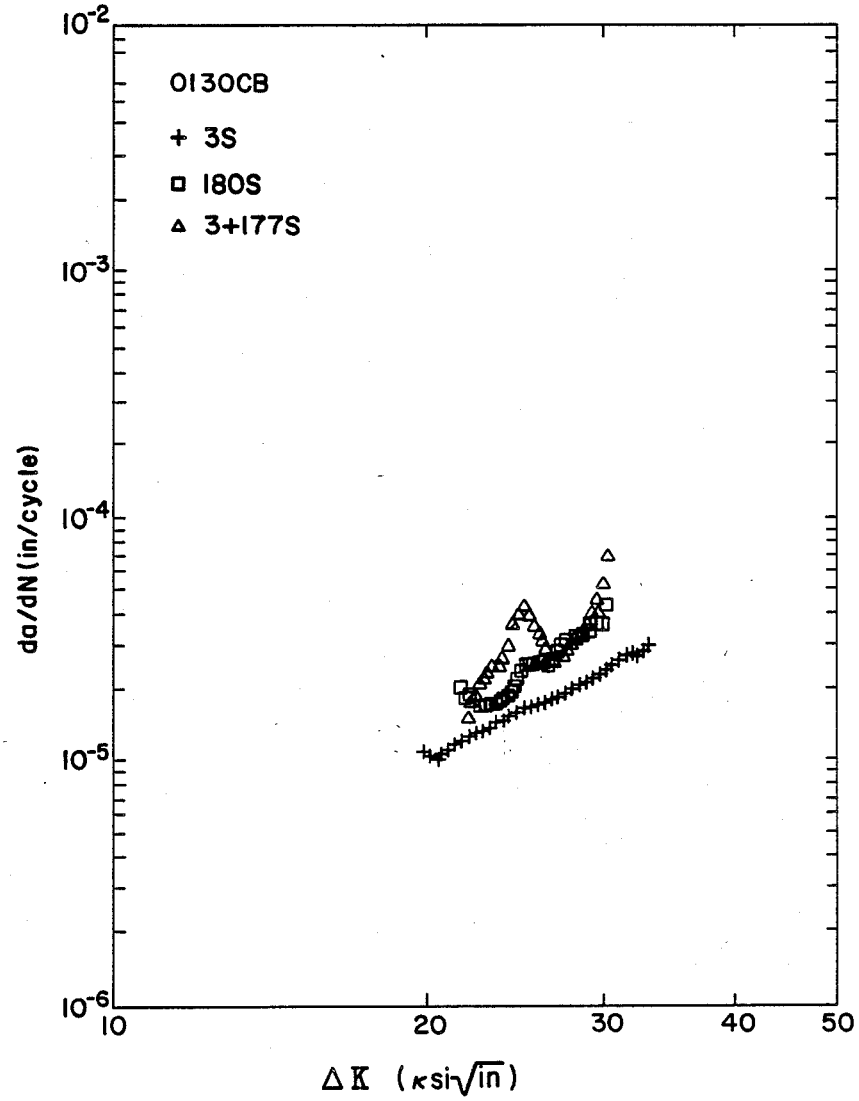
FIGS. 1–6 are graphic (log-log plot) representations of fatigue crack growth rates (da/dN) obtained at 1200° F. at various stress intensities ($\Delta K$) for the same alloy, after different cooling rates from elevated supersolvus solution annealing temperatures, under cyclic stress applications at a series of frequencies one of which cyclic stress applications includes a hold time at maximum stress intensity.
Figure 2:
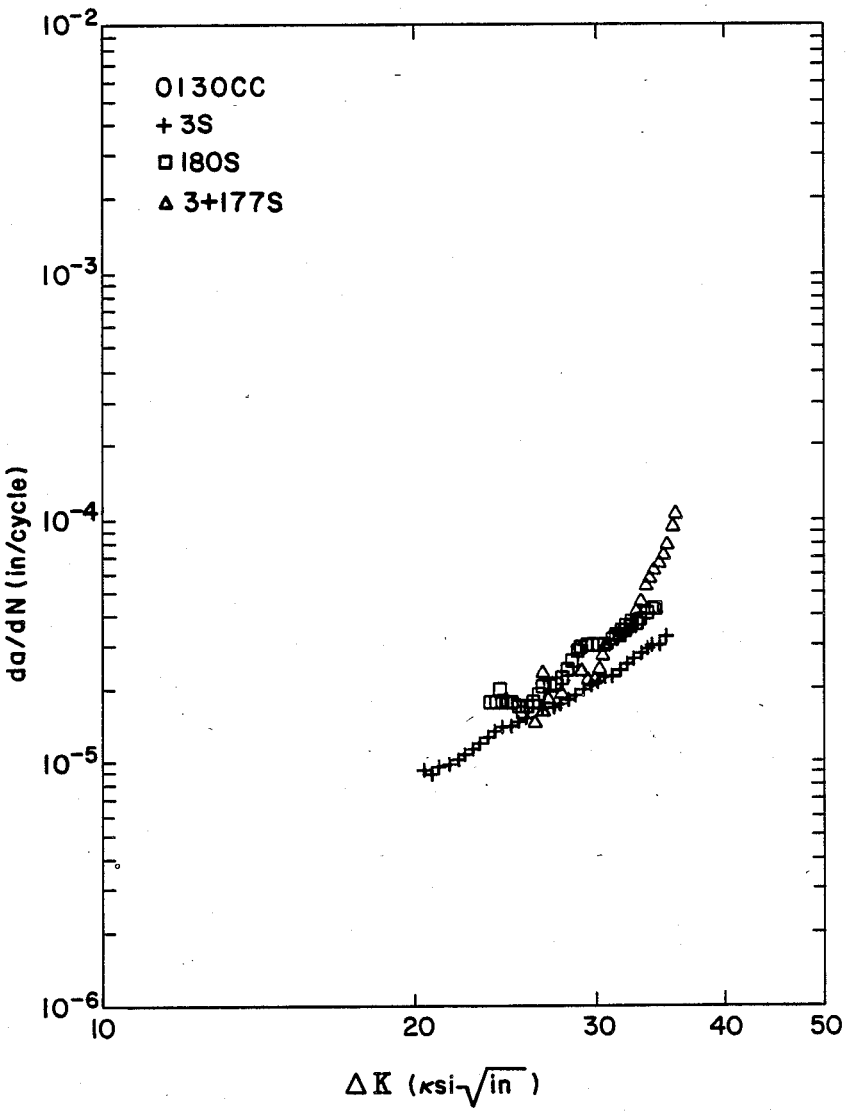
Figure 3:
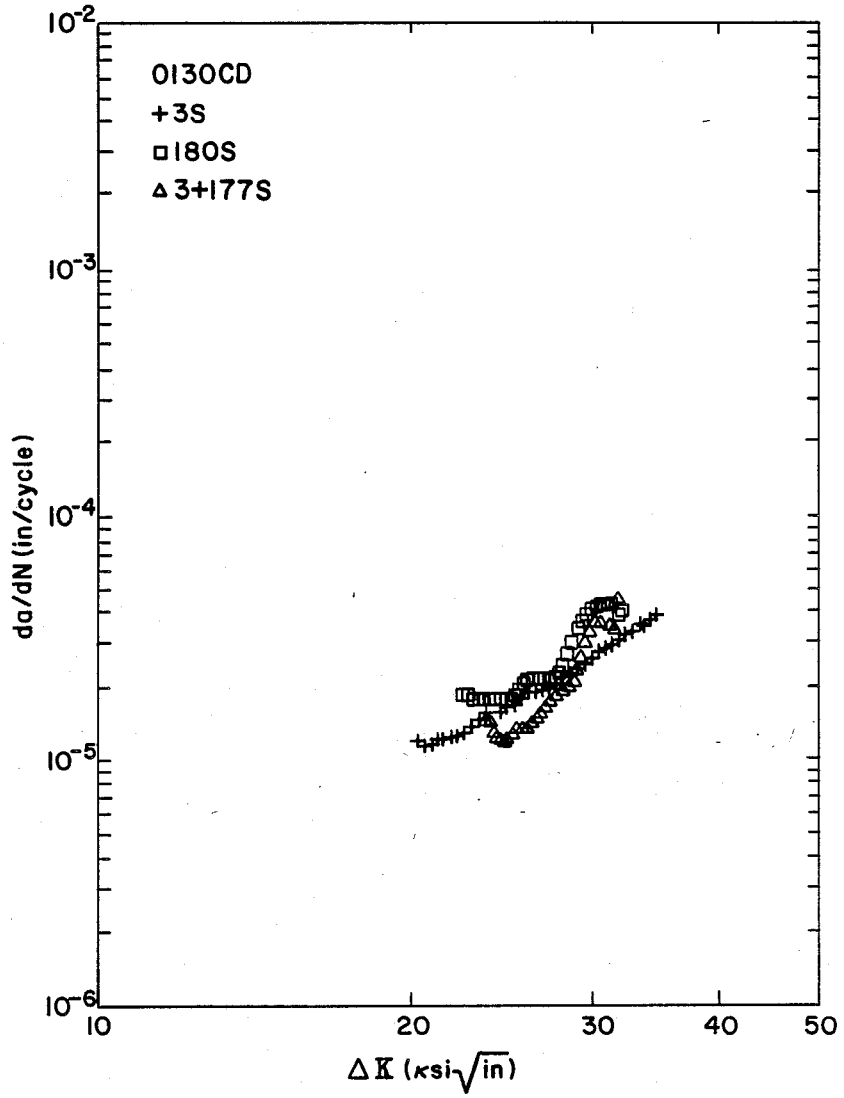
Figure 4:
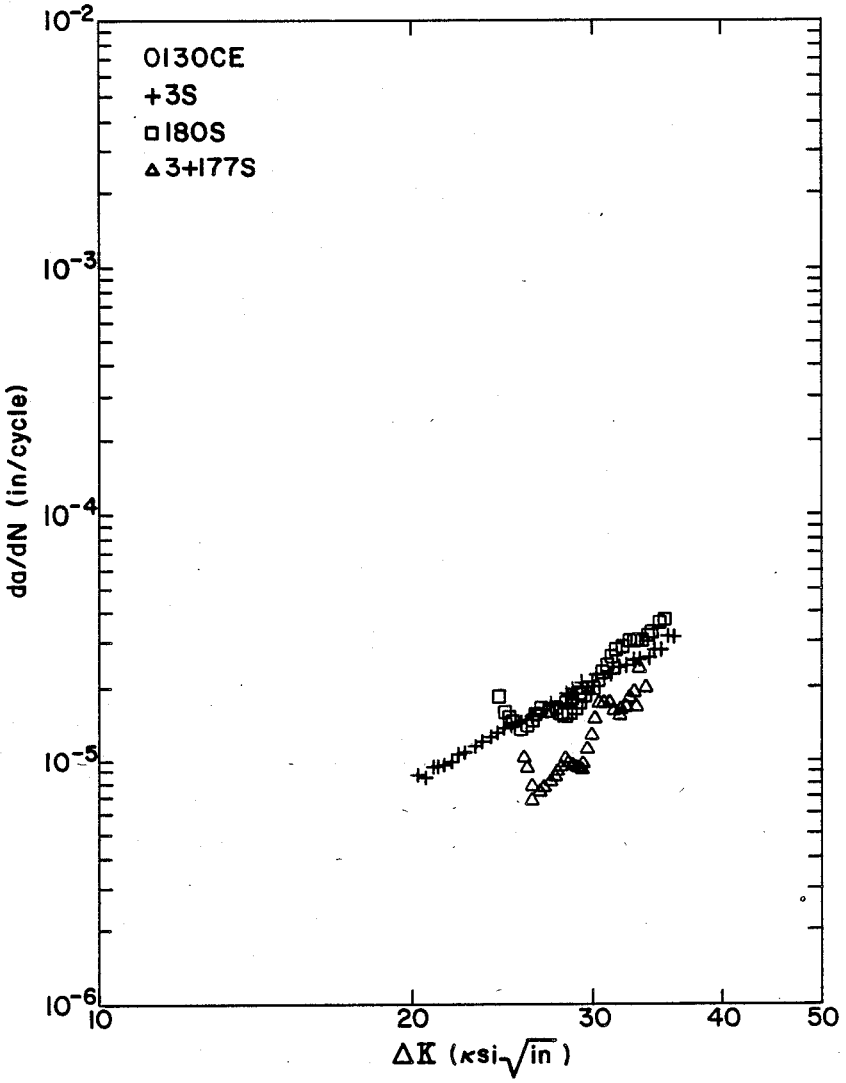
Figure 5:
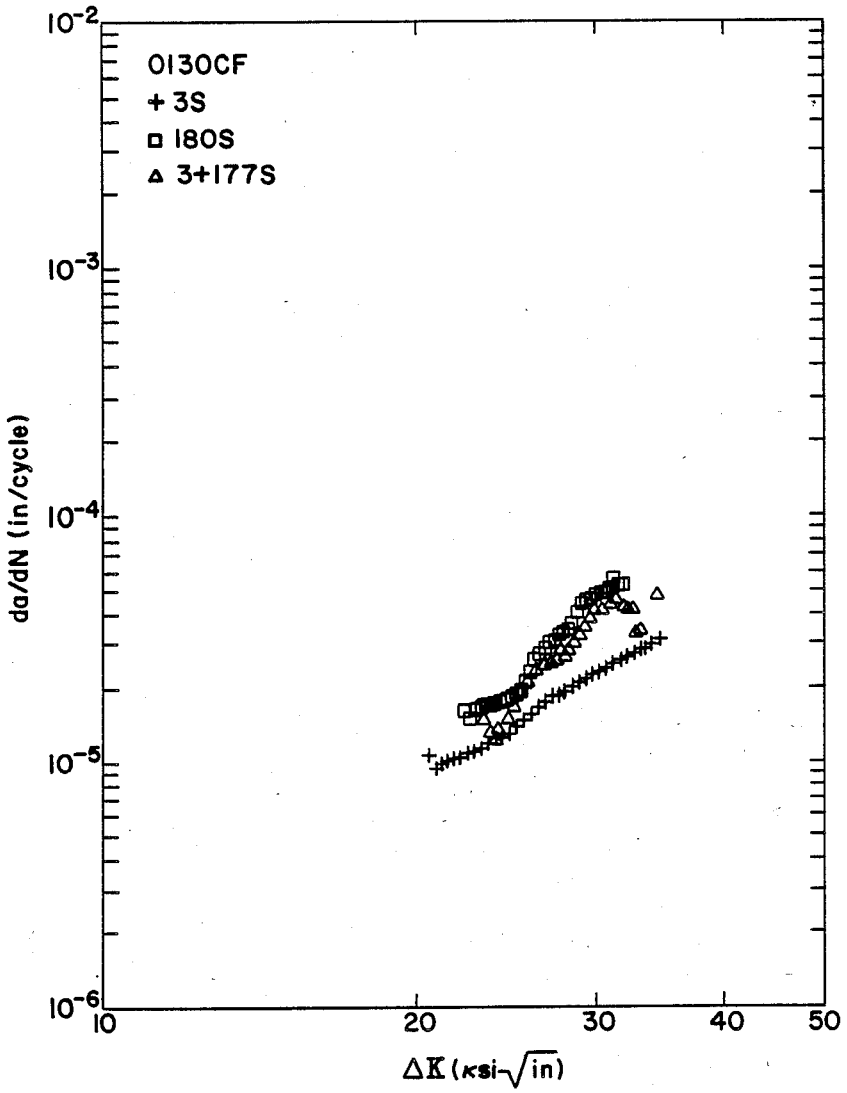
Figure 6:
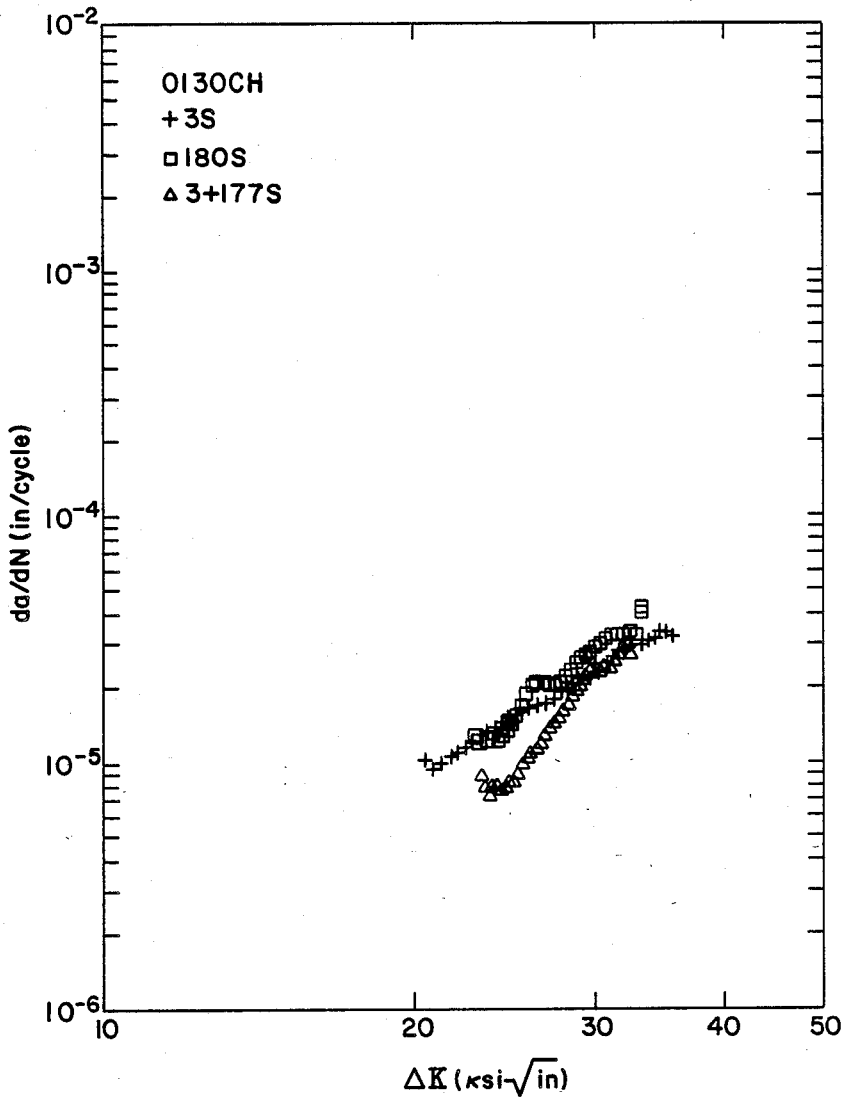

Pursuant to the present invention a superalloy which has excellent forgeability is provided. The superalloy of the invention can be prepared by casting and the cast alloy can be wrought. Further the superalloy of the invention can be prepared by advanced metal processing procedures such as powder metallurgy procedures and spray forming procedures such as by the commercially known Osprey process. The superalloy prepared by such advanced processing procedures can also be effectively wrought or forged.

The present invention also encompasses a method for processing the superalloy to produce material with a superior set or combination of properties for use in advanced engine disk applications.

The properties which are conventionally needed for materials used in disk applications include high tensile strength and high stress rupture strength. In addition the alloy of the subject invention exhibits a desirable property of resisting crack growth propagation. Such ability to resist crack growth is essential for the component low cycle fatigue life or LCF.

In addition to this superior set of properties as outlined above, the alloy of the present invention displays good forgeability and such forgeability permits greater flexible to metal processing.

EXAMPLE 1

An alloy was prepared by vacuum melting and casting procedure. The alloy was prepared by first vacuum induction melting and by then casting into a 4.0 inch diameter chilled copper mold under partial argon pressure.

The ingredient content of the alloy was prescribed according to the following composition:

TABLE I

| MONIMAL COMPOSITION OF CH-59A | | |
|---|---|---|
| | wt. % | at. % |
| Ni | bal. | bal. |
| Co | 18.00 | 18.02 |
| Cr | 16.00 | 18.16 |
| Mo | 5.00 | 3.08 |
| W | 5.00 | 1.60 |

TABLE I-continued

| MONIMAL COMPOSITION OF CH-59A | | |
|---|---|---|
| | wt. % | at. % |
| Al | 2.50 | 5.47 |
| Ti | 3.00 | 3.70 |
| Nb | 3.00 | 1.77 |
| Zr | 0.05 | 0.03 |
| B | 0.01 | 0.05 |
| C | 0.075 | 0.37 |

The alloy of Table I is a superalloy which forms a strengthening $\gamma'$ precipitate. The alloy was designated alloy CH-59A.

I have found that the alloy of the composition as set forth in Table I has a novel lower solvus temperature for its $\gamma'$ precipitate. The solvus temperature for the alloy of Table I has a relatively lower solvus temperature as compared to closely comparable alloys which have lower cobalt concentrations. Surprisingly I have found that because of the relatively high cobalt concentration of my composition as set forth above this alloy has a most unique character in that its solvus temperature is relatively low.

Because of its relatively low solvus temperature, a unique set of advantages of forgeability as well as advantages of supersolvus annealing are provided.

The precipitate solvus of the composition was determined to be 1080° C. or 1975° F. A solution temperature of 1125° C. (or 2057° F.) was selected for solutioning treatment of the precipitate of the alloy. After solution treatment, the alloy received a single aging treatment at 760° C. for 16 hours (1400° F./16 hours).

EXAMPLES 2–4

PREPARATION OF SPRAY FORMED SAMPLES

Spray forming technique was applied to prepare a sprayed alloy specimen. For the spray forming, one 40 lb. heat of an alloy composition set forth in Table I was prepared by vacuum induction melting (VIM) and was cast in a 4.0 in. diameter, chilled copper mold under partial argon pressure.

The ingot was remelted in a spraying chamber, a descending stream of molten metal was formed, and the stream was atomized by argon gas. The metal droplets formed by the atomization were deposited on a rotating ceramic collector of 5.375 inch diameter to form a disk preform.

Blocks measuring 3.0 inches by 3.0 inches by 1.5 inches were cut from the preforms and were hot press forged to accomplish a 3 to 1 reduction in height. The total press forging consisted of three pushes with reheating between pushes. The first two forgings were done with the alloy specimen temperature set at 1125° C. The specimen temperature was reduced to 1100° C. for the last forging step. The reduction in height in the last forging was 33%. This forging specimen was designated as 0130A.

EXAMPLES 5–7

PREPARATION OF POWDER METALLURGY SAMPLES

A master heat having a composition as set forth in Table I was prepared by vacuum induction melting as described above to form an 18 lb. ingot. Powder atomization was performed in a gas atomizer using argon gas. Screened powder of −140 mesh were collected. The collected powder was placed in a metal can as conventionally used for hot isostatic pressing and the can was evacuated and sealed.

The sealed can was HIPped at 1100° C. (2012° F.) at 15 ksi (103 MPa) for four hours. The as-HIPped can had a rectanguloid form and dimensions of 1.5 inches by 3.0 inches by 4.0 inches.

The as-HIPped can was hot pressed at 1125° C. to reduce one dimension by 37.5%. The pressed can was reheated to 1080° C. and flat pressed into a 1.0 inch thick pancake with a 44% reduction in height. This forging was identified as T219B.

EXAMPLES 2–7

TREATMENTS AND TESTING

A standard heat treatment was applied to the specimens of examples 2–7. The treatment was a solution annealing for one hour at 1125° C. (2057° F.) for one hour followed by chamber cooling at 200° F. per minute and isothermal aging at 760° C. (1400° F.) for 16 hours.

Standard round tensile bars of 0.10 in. gauge diameter were machined and low-stress ground for both tensile and stress rupture testing. Fatigue crack propagation (FCP) tests were performed by employing a single-edge notched (SEN) specimen and a dc electric potential drop technique. Different cyclic waveforms, as described above with reference to the NASA study, were employed in the testing.

The cycles included standard 20 cycles per minute (cpm) sinusoidal cycle (3 second per cycle); 60 times slower at 0.33 cpm sinusoidal cycle (180 second per cycle); and 20 cpm sinusoidal cycle with a 177 second hold at peak load (180 second per cycle). The minimum to maximum load ratio R was kept at 0.05 in all waveforms.

The tensile properties as functions of the testing temperature are shown in Table 2. Alloy CH-59A exhibits good strength up to 1200° F., and both tensile and yield strength start to decrease at 1400° F. The two materials 0130A and T219A exhibit the same relationship between their strength and testing temperature, though spray forming 0130A shows somewhat lower yield strength at high temperatures than powder metallurgy T218B.

TABLE 2

| | TENSILE RESULTS | | | | |
|---|---|---|---|---|---|
| Material | TEST TEMP. (°F.) | YIELD STRENGTH (ksi) | TENSILE STRENGTH (ksi) | UNIFORM ELONG. (%) | TOTAL ELONG. (%) |
| 0130A | 750 | 177.2 | 228.8 | 8.8 | 8.8 |
| 0130A | 1000 | 167.5 | 230.5 | 10.2 | 10.2 |
| 0130A | 1200 | 165.9 | 242.7 | 10.5 | 17.8 |
| 0130A | 1400 | 152.7 | 172.0 | 2.1 | 18.3 |
| T219B | 75 | 188.7 | 248.7 | 13.3 | 15.4 |
| T219B | 750 | 173.5 | 229.6 | 10.1 | 10.1 |
| T219B | 1200 | 170.8 | 243.7 | 11.6 | 16.1 |

TABLE 2-continued

| Material | TEST TEMP. (°F.) | TENSILE RESULTS YIELD STRENGTH (ksi) | TENSILE STRENGTH (ksi) | UNIFORM ELONG. (%) | TOTAL ELONG. (%) |
|---|---|---|---|---|---|
| T219B | 1400 | 162.7 | 178.1 | 2.1 | 14.3 |

Table 3 lists the testing conditions and measured data for stress rupture tests. The results obtained from two materials are consistent with each other.

TABLE 3

| Material | INITIAL STRESS (ksi) | STRESS RUPTURE RESULTS TEST TEMP. (°F.) | RUPTURE LIFE (hrs) | ELONG. (%) | L-M P/1000 (C = 25) | 100 hr TEMP. (°F.) |
|---|---|---|---|---|---|---|
| 0130A | 75 | 1400 | 66.7 | 5.1 | 49.9 | 1387.9 |
| 0130A | 125 | 1200 | 766.0 | 3.8 | 46.3 | 1254.4 |
| 0130A | 135 | 1225 | 350.4 | 5.1 | 46.4 | 1259.0 |
| T219B | 80 | 1400 | 24.2 | 3.3 | 49.1 | 1357.6 |
| T219B | 135 | 1225 | 279.2 | 2.9 | 46.2 | 1252.8 |

L-M : Larson-Miller parameter (T + 460)*(C + log t).

The data obtained from the fatigue crack growth rate measurements was obtained and is plotted in the FIGS. 1–6. These figures show the fatigue crack growth rate da/dN in inches per cycle plotted against the applied stress on a log/log plot.

Three different cyclic wave forms were employed in the tests and measurements of the fatigue crack growth rate. The first cyclic wave form was at a 3 second sinusoidal application of stress, the second was at a 180 second sinusoidal application of stress and the third was a 3 second sinusoidal application of stress with a 177 second hold at the maximum stress of the sinusoidal cycle. Also in these tests, the minimum to maximum load ratio was set at R=0.5, or in other words the maximum stress was 20 fold greater than the minimum stress which was applied during each sinusoidal cycle.

Each of the samples was cooled at different rates indicated on the respective figures. The data plotted shows a favorable and desirable low crack growth rate and similarly shows a minimum time dependence of its fatigue crack growth rate.

One of the remarkable features of this invention is the provision of an alloy which can be processed over a wide range of cooling rates to achieve a highly desirable set of properties. It is known that conventional nickel based $\gamma'$ strengthened superalloys achieve higher strength after rapid cooling than they do after slow cooling.

For this reason there has been an impetus in processing superalloys to cool them rapidly after a partial supersolvus anneal.

However I have discovered that there is a distinct advantage in improving, by reducing, fatigue crack propagation rates by reducing the rate of cooling of conventional nickel base $\gamma'$ strengthened superalloys after they have been supersolvus annealed. This is explained in copending application Ser. No. 907,550 (Attorney Docket RD-17,159) filed simultaneously therewith.

What is remarkable about the alloy of the present invention is that it can be subjected to a wide range of cooling rates extending over a full order of magnitude from 20° C./min to 200° C./min without very substantial change in the resultant strength of the alloy. This is in part indicated by the low slope of the plots of FIG. 7 in comparison to those of FIG. 8 as discussed below.

Figure 7:
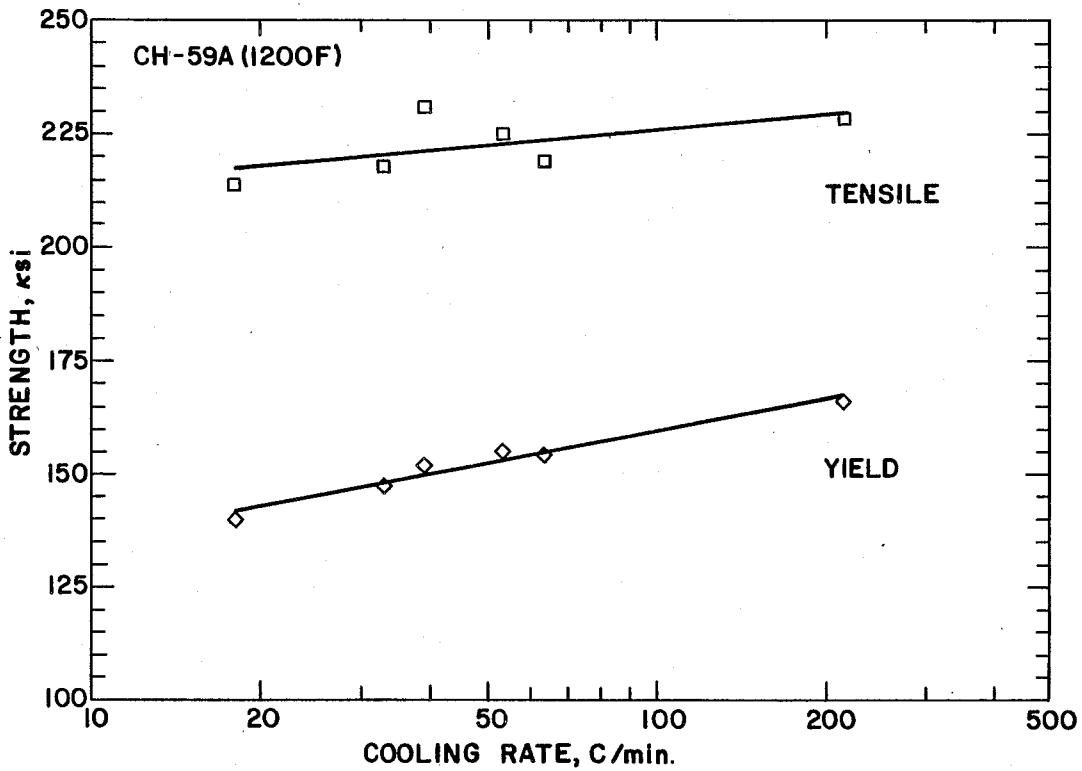
FIGS. 7 and 8 are graphs in which strength in ksi is plotted as ordinate against cooling rate in °C. per minute abscissa.

Measurements were also made of the relative low strengths of each of the samples prepared, as indicated above, and the relationship or the function of the cooling rate relative to the strength is plotted in FIG. 7. It is evident from the figure that generally the higher cooling rates favor higher tensile strength and yield strength. However, the tensile and yield strength achieved at the lowest heating rate is still very substantial. As indicated in the table, the heating of the tensile and yield strengths were measured at 1200° F. For comparison, similar measurements were made with samples of Rene' 95 which were also supersolvus annealed and cooled at different rates. Rene' 95 is known to be the strongest commercially available superalloy. The data obtained from measurements of tensile and yield strengths of the Rene' 95 samples, which have been cooled at the different rates, is plotted in FIG. 8 and is evident from the figure and the comparison of the figure with that of FIG. 7, the alloy of the present invention has an advantage of 5 to 10 ksi over the strengths registered for the Rene' 95 alloy sample.

Next comparative stress rupture tests were conducted. These tests were conducted at 1200° F., with an initial load of 150 ksi, on each of two samples, one being a sample of the alloy of the subject invention and the other being a sample of the Rene' 95 alloy. The data was collected and it is plotted in FIG. 9. The data for the lower line represents the Rene' 95 data and that of the upper line represents the alloy of the present invention. Rupture life is plotted as ordinate and cooling rate as abscissa. From the data plotted in FIG. 9, it is evident that the alloy of the present invention has a life expectancy of 3 to 5 times greater than that of Rene' 95 under this rupture life test procedure.

It is obvious from the foregoing that the present invention provides a unique, novel and unobvious composition which has a remarkable combination of properties. The uniqueness is evident from the data plotted in the figures.

In addition, the alloy of the subject invention has a number of advantages which relate to the low precipitate solvents temperature part of which relate to properties achieved and part of of which relate to advantages is metal processing.

For example, a low forging temperature is feasible with the alloy of the subject invention. In addition, a low solution temperature can be used in the solutioning of the $\gamma'$ precipitate.

A most important advantage of the lower solvus temperature is that a lower thermal stress will be induced during a cooling of the sample from its solvus or supersolvus temperature.

Figure 8:
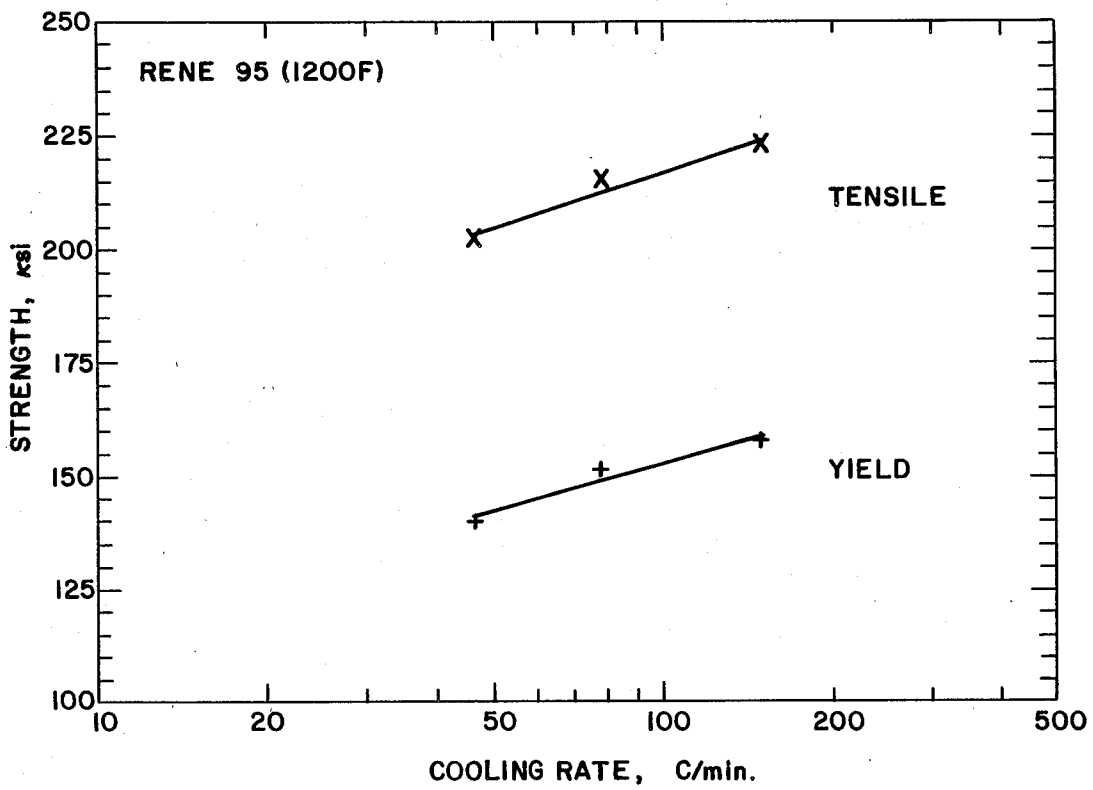
Figure 9:
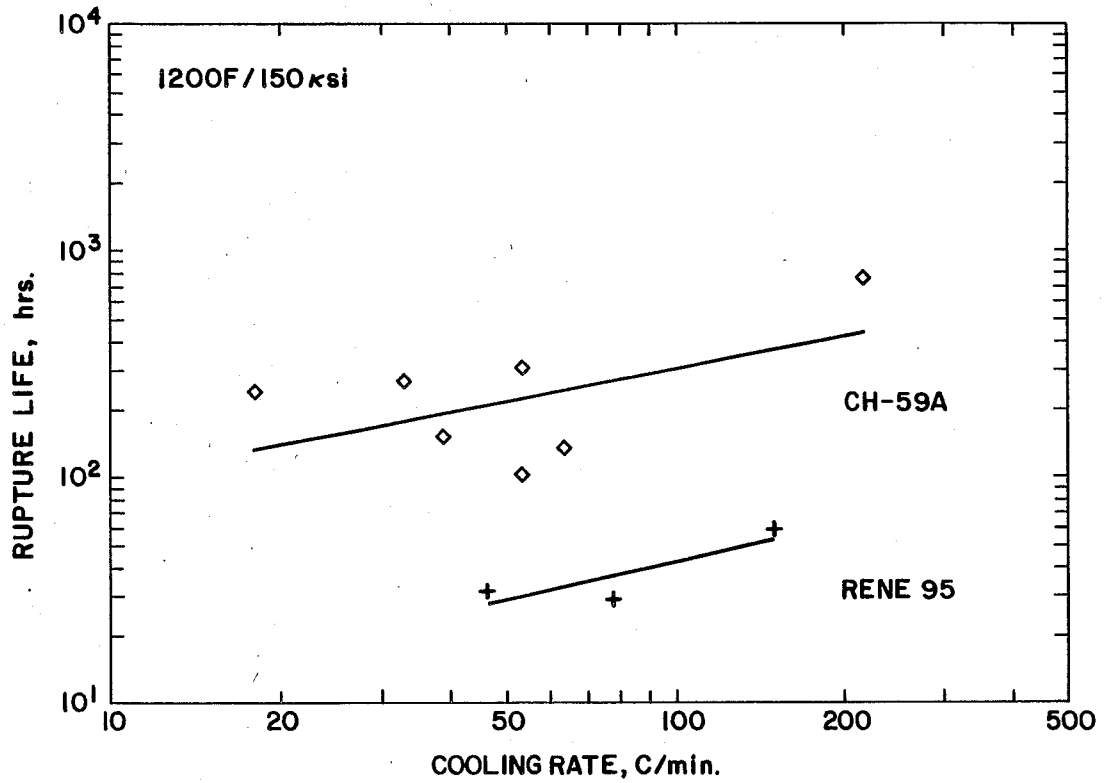
FIG. 9 is a plot of rupture life as a function of cooling rate.

It is further evident from the FIGS. 7, 8 and 9, that greater strengths were achieved and a greater rupture life has resulted from samples of the alloy of the present invention which had been cooled at faster cooling rates. This finding contrasts with the knowledge in the industry that quench cracking is a serious problem for nickel-base superalloys which are cooled quickly from their supersolvus temperature.

Essentially the same unique combination properties are found in the alloy of this invention when processed by conventional powder metallurgy techniques.

Further niobium can be replaced by tantalum in a 2 to 1 ratio. In other words for each 1% of niobium which is omitted 2% of tantalum is added where the measurement of the ingredients is on a weight percent basis. On an atomic percent basis the concentration of tantalum added is equivalent to the concentration of niobium omitted.

What is claimed and sought to be protected by Letters Patent of the United States is as follows:

1. A nickel base superalloy composition consisting essentially of the following composition

| Element | Composition in weight % | |
|---|---|---|
| | From | To |
| Ni | balance | |
| Cr | 13 | 18 |
| Co | 15 | 20 |
| Mo | 3 | 6 |
| W | 3 | 6 |
| Al | 2 | 4 |
| Ti | 2 | 4 |
| Nb | 2 | 4 |
| Zr | 0.02 | 0.08 |
| B | 0.005 | 0.03 |
| C | less than 0.1. | |

said composition having been supersolvus annealed and slowly cooled.

2. The alloy of claim 1 which has a low fatigue crack propagation rate and which has been supersolvus annealed and cooled at a rate of less than 250° C./min.

3. The alloy of claim 1 which has a low fatigue crack propagation rate, which has been supersolvus annealed and which has been cooled at a rate between 20° C./min and 200° C./min.

4. The alloy of claim 1 in which the solvus temperature is about 1080° C.

5. The alloy of claim 1 in which the composition is as follows:

| Element | Composition in weight % |
|---|---|
| Ni | balance |
| Cr | 16 |
| Co | 18 |
| Mo | 5.00 |
| W | 5.00 |
| Al | 2.50 |
| Ti | 3.00 |
| Nb | 3.00 |
| Zr | 0.05 |
| B | 0.01 |
| C | 0.075 |

6. The method of preparing a nickel base superalloy which comprises preparing a melt consisting essentially of the following approximate ingredient content

| Element | Composition in weight % | |
|---|---|---|
| | From | To |
| Ni | balance | |
| Cr | 13 | 18 |
| Co | 15 | 20 |
| Mo | 3 | 6 |
| W | 3 | 6 |
| Al | 2 | 4 |
| Ti | 2 | 4 |
| Nb | 2 | 4 |
| Zr | 0.02 | 0.08 |
| B | 0.005 | 0.03 |
| C | less than 0.1. | |

cooling the melt to a solid, supersolvus annealing the solid, and cooling the solid at a rate of 250° C./min. or less.

7. The method of claim 6 in which the cooling rate is between 20° C./min and 200° C./min.

8. The method of claim 6 in which the solid is subjected to heat aging following the cooling.

9. The method of claim 6 in which the solid is subjected to heat aging at about 760° C. for about 16 hours.

10. The method of claim 6 in which the composition is as follows:

| Element | Composition in weight % |
|---|---|
| Ni | balance |
| Cr | 16 |
| Co | 18 |
| Mo | 5.00 |
| W | 5.00 |
| Al | 2.50 |
| Ti | 3.00 |
| Nb | 3.00 |
| Zr | 0.05 |
| B | 0.01 |
| C | 0.075 |

11. The method of claim 6 in which the alloy is forged after cooling from the melt.

12. The method of claim 6 in which the cooling of the melt to a solid is by powder atomization.

13. The method of claim 6 in which the cooling of the melt to a solid is by spray forming.

* * * * *